US012421016B2

(12) United States Patent
Weaver

(10) Patent No.: US 12,421,016 B2
(45) Date of Patent: Sep. 23, 2025

(54) CARTON WITH DISPENSER

(71) Applicant: Graphic Packaging International, LLC, Atlanta, GA (US)

(72) Inventor: Sharon M. Weaver, Chicago, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 18/102,109

(22) Filed: Jan. 27, 2023

(65) Prior Publication Data

US 2023/0242328 A1 Aug. 3, 2023

Related U.S. Application Data

(60) Provisional application No. 63/304,110, filed on Jan. 28, 2022.

(51) Int. Cl.

| | |
|---|---|
| ***B65D 83/08*** | (2006.01) |
| ***B65D 5/02*** | (2006.01) |
| ***B65D 5/54*** | (2006.01) |

(52) U.S. Cl.

CPC ..... *B65D 83/0805* (2013.01); *B65D 5/0227* (2013.01); *B65D 5/542* (2013.01)

(58) Field of Classification Search

CPC ... B65D 5/0227; B65D 5/542; B65D 83/0805

See application file for complete search history.

(56) References Cited

U.S. PATENT DOCUMENTS

| | | | |
|---|---|---|---|
| 978,569 | A | 12/1910 | Elkin |
| 1,651,848 | A | 12/1927 | Stevens |
| 1,667,376 | A | 4/1928 | Fehrenkamp |
| 1,824,862 | A | 9/1931 | Young |

(Continued)

FOREIGN PATENT DOCUMENTS

| | | |
|---|---|---|
| DE | 196 42 571 | 5/1997 |
| DE | 203 17 334 | 2/2004 |

(Continued)

OTHER PUBLICATIONS

International Search Report and Written Opinion for PCT/US2023/011670 dated May 25, 2023.

*Primary Examiner* — Nathan J Newhouse
*Assistant Examiner* — Phillip D Schmidt
(74) *Attorney, Agent, or Firm* — FisherBroyles, LLP

(57) ABSTRACT

A carton for holding and dispensing at least one article includes a plurality of panels extending at least partially around an interior of the carton and including a front panel, a back panel, and at least one side panel, a plurality of end flaps foldably connected to respective panels of the plurality of panels for forming at least one closed end of the carton, and a dispenser for accessing the interior of the carton, the dispenser including a dispenser opening in the top panel, a first article engaging member attached to the top panel, and a second article engaging member attached to the top panel, the first article engaging member and the second article engaging member arranged in at least partial overlapping relation to define a dispenser path from the interior of the carton to an exterior environment around the carton, at least one of the first article engaging member and the second article engaging member comprises a composite material.

24 Claims, 4 Drawing Sheets

(56) References Cited

U.S. PATENT DOCUMENTS

D115,651 S 7/1939 Ford et al.
D120,673 S 5/1940 Jung
2,312,595 A 3/1943 Smith
2,348,378 A 5/1944 Goodyear
2,363,861 A 11/1944 Goodyear
2,565,146 A 8/1951 Okon
2,586,301 A 2/1952 Castle
2,737,326 A 3/1956 Toensmeier
2,764,284 A 9/1956 Arneson
2,794,585 A 6/1957 Wagner
2,950,041 A 8/1960 Stone
2,967,610 A 1/1961 Ebert et al.
3,013,710 A 12/1961 Kronson et al.
3,107,039 A 10/1963 Painter
3,239,097 A * 3/1966 Bates ..... B65D 83/0805 229/125.05
3,245,711 A 4/1966 Dantoin
3,257,027 A 6/1966 Weiss
3,493,261 A 2/1970 Stout et al.
3,612,266 A 10/1971 Graser
3,640,380 A 2/1972 Huffman
3,722,945 A 3/1973 Wood
3,767,041 A 10/1973 Graser
3,979,019 A * 9/1976 Bliss ..... B65D 5/62 221/48
D242,901 S 1/1977 Lohrbach
4,007,869 A 2/1977 Stolkin et al.
4,008,849 A 2/1977 Baber
4,039,120 A 8/1977 Herzog
4,131,198 A 12/1978 Fischer
4,164,286 A 8/1979 Sutherland
4,188,766 A 2/1980 Culpepper
4,192,540 A 3/1980 Oliff
4,238,069 A 12/1980 Morris, Jr.
4,326,628 A 4/1982 Wood
4,336,898 A 6/1982 Joyce
4,397,393 A 8/1983 Pergande et al.
4,432,579 A 2/1984 Denmark et al.
4,438,843 A 3/1984 Graser
4,489,880 A 12/1984 Calvert
4,530,459 A 7/1985 Maroszek
4,566,591 A 1/1986 Turtschan et al.
4,601,390 A 7/1986 Rosenthal et al.
4,703,847 A 11/1987 Oliff
4,815,609 A 3/1989 Kiedaisch
4,993,625 A 2/1991 Stease et al.
D319,388 S 8/1991 McIntosh, Jr. et al.
5,135,104 A 8/1992 Jorba
5,188,225 A 2/1993 Jorba
5,219,421 A 6/1993 Tipping
5,299,734 A 4/1994 Lane
5,323,895 A 6/1994 Sutherland et al.
5,325,992 A 7/1994 Koller
5,351,815 A 10/1994 Fogle et al.
5,400,901 A 3/1995 Harrelson
5,402,931 A 4/1995 Gulliver et al.
5,407,065 A 4/1995 Sutherland
5,439,112 A 8/1995 De Guglielmo et al.
5,445,262 A 8/1995 Sutherland
5,484,059 A 1/1996 Sutherland
5,501,323 A * 3/1996 Denesha ..... B65D 83/0805 229/242
5,501,335 A 3/1996 Harris
5,503,267 A 4/1996 Sutherland
5,524,814 A 6/1996 Davis
D373,079 S 8/1996 Fahlen
5,542,598 A * 8/1996 Capo ..... B65D 83/0805 221/45
5,551,556 A 9/1996 Sutherland
5,582,345 A 12/1996 Lankhuijzen
5,588,586 A 12/1996 Negelen
5,595,291 A 1/1997 Negelen
5,598,920 A 2/1997 Hansen
5,620,094 A 4/1997 Naumann
5,638,956 A 6/1997 Sutherland
D386,680 S 11/1997 Johnson
5,687,838 A 11/1997 Bakx
5,704,483 A 1/1998 Groh
5,845,776 A 12/1998 Galbierz et al.
5,921,392 A 7/1999 Davis
5,950,912 A 9/1999 Economopoulos
5,957,289 A 9/1999 Negelen
5,960,945 A 10/1999 Sutherland
5,984,086 A 11/1999 Foushee et al.
6,021,897 A 2/2000 Sutherland
6,223,892 B1 5/2001 Bakx
6,315,111 B1 11/2001 Sutherland
6,439,452 B1 8/2002 Tsao
6,488,322 B2 12/2002 Bakx
6,530,516 B1 3/2003 Ritter
6,550,639 B2 * 4/2003 Brown ..... D06M 10/00 15/1.52
6,615,984 B2 9/2003 Saulas et al.
6,817,484 B2 * 11/2004 Morin ..... B65D 83/0894 221/48
6,866,189 B2 3/2005 Nelson
D525,866 S 8/2006 Oliveira
7,083,046 B2 8/2006 Bakx
D532,690 S 11/2006 Oliveira
7,159,760 B2 1/2007 Pluck et al.
7,264,114 B2 9/2007 Daniel
7,617,969 B2 11/2009 Oliveira
7,621,439 B2 11/2009 McClure
7,762,450 B2 7/2010 Oliveira
7,793,821 B2 9/2010 Oliveira
7,803,726 B2 9/2010 Policicchio et al.
8,162,135 B2 4/2012 Oliveira
8,225,985 B2 7/2012 Oliveira
D675,514 S 2/2013 Baker
8,646,653 B2 2/2014 Lien et al.
8,978,889 B2 3/2015 Fitzwater et al.
9,139,355 B2 * 9/2015 Yao ..... B65B 51/02
9,487,340 B2 11/2016 Castela
9,533,822 B2 1/2017 Policicchio
9,598,202 B2 3/2017 Oliveira et al.
9,630,736 B2 4/2017 Oliveira
9,840,358 B2 12/2017 Oliveira
10,610,078 B2 4/2020 Oliveira
2002/0108962 A1 8/2002 Mangin
2002/0113449 A1 8/2002 Bakx
2003/0106926 A1 6/2003 Beatificato et al.
2003/0155263 A1 * 8/2003 Morin ..... B65D 83/0805 206/494
2003/0155264 A1 8/2003 Morin
2003/0213705 A1 11/2003 Woog
2004/0026440 A1 2/2004 Kruchoski et al.
2004/0079666 A1 4/2004 Bakx
2004/0089656 A1 5/2004 Watkins
2004/0200854 A1 10/2004 Brickwood
2004/0226833 A1 11/2004 Daniel
2006/0049067 A1 3/2006 McDonald
2006/0091190 A1 5/2006 Nikolai
2007/0000794 A1 1/2007 Requena
2008/0202946 A1 8/2008 Jego
2010/0307932 A1 12/2010 Mezzini
2019/0127111 A1 5/2019 Kearns

FOREIGN PATENT DOCUMENTS

DE 20 2004 004 248 8/2004
DE 20 2004 017 954 2/2005
EP 0 048 506 3/1982
EP 0 285 043 10/1988
EP 0 398 835 11/1990
EP 0 495 197 7/1992
EP 0 541 334 5/1993
EP 0 639 504 2/1995
EP 0 780 320 6/1996
EP 1 070 671 1/2001
EP 1 384 679 1/2004
EP 1 661 813 5/2006
FR 1 582 235 9/1969
FR 2 525 992 11/1983
FR 2 664 239 1/1992

(56) References Cited

FOREIGN PATENT DOCUMENTS

| | | | | |
|---|---|---|---|---|
| FR | 2 731 413 | | | 9/1996 |
| GB | 889 718 | | | 2/1962 |
| GB | 1 342 180 | | | 12/1973 |
| GB | 2 085 391 | | | 4/1982 |
| GB | 2 158 037 | | | 11/1985 |
| JP | 10-167352 | A | | 6/1998 |
| JP | 2000-281155 | A | | 10/2000 |
| JP | 2004524234 | | | 12/2004 |
| JP | 2018-202211 | A | | 12/2018 |
| KR | 10-0472517 | B1 | | 6/2005 |
| KR | 20110009466 | U | * | 10/2011 |
| SE | 140 388 | | | 5/1953 |
| WO | WO 91/05448 | | | 4/1991 |
| WO | WO 97/33807 | | | 9/1997 |
| WO | WO 98/49071 | | | 11/1998 |
| WO | WO 99/01356 | | | 1/1999 |
| WO | WO 02/40374 | | | 5/2002 |
| WO | WO 02/059011 | | | 8/2002 |
| WO | WO 02/062676 | | | 8/2002 |
| WO | WO 02/079048 | | | 10/2002 |
| WO | WO 03/016167 | | | 2/2003 |
| WO | WO 2005/085091 | | | 9/2005 |
| WO | WO 2005/095222 | | | 10/2005 |
| WO | WO 2006/044583 | | | 4/2006 |
| WO | WO 2006/108098 | | | 10/2006 |
| WO | WO 2007/044525 | | | 4/2007 |

* cited by examiner

CARTON WITH DISPENSER

CROSS-REFERENCE TO RELATED APPLICATION

This application claims the benefit of U.S. Provisional Patent Application No. 63/304,110, filed on Jan. 28, 2022.

INCORPORATION BY REFERENCE

The disclosure of U.S. Provisional Patent Application No. 63/304,110, filed on Jan. 28, 2022, is hereby incorporated by reference for all purposes as if presented herein in its entirety.

BACKGROUND

The present disclosure generally relates to cartons for holding and dispensing articles.

SUMMARY

According to one aspect, the disclosure is generally directed to a carton for holding and dispensing at least one article, the carton comprising a plurality of panels extending at least partially around an interior of the carton and comprising a front panel, a back panel, and at least one side panel, a plurality of end flaps foldably connected to respective panels of the plurality of panels for forming at least one closed end of the carton. The carton further comprises a dispenser for accessing the interior of the carton, the dispenser comprising a dispenser opening, a first article engaging member attached to the top panel, and a second article engaging member attached to the top panel, the first article engaging member and the second article engaging member arranged in at least partial overlapping relation to define a dispenser path from the interior of the carton to an exterior environment around the carton, at least one of the first article engaging member and the second article engaging member comprises a composite material.

According to another aspect, the disclosure is generally directed to a blank for forming a carton for holding and dispensing at least one article, the blank comprising a plurality of panels comprising a front panel, a back panel, and at least one side panel, a plurality of end flaps foldably connected to respective panels of the plurality of panels for forming at least one closed end of the carton. The blank further comprises dispenser features for forming a dispenser for accessing the interior of the carton formed from the blank, the dispenser features comprising a dispenser opening in the top panel, a first article engaging member attached to the top panel, and a second article engaging member attached to the top panel, the first article engaging member and the second article engaging member arranged in at least partial overlapping relation to define a dispenser path from the interior of the carton formed form the blank to an exterior environment around the carton formed from the blank, at least one of the first article engaging member and the second article engaging member comprises a composite material.

According to another aspect, the disclosure is generally directed to a method of forming a carton for holding and dispensing at least one article, the method comprising obtaining a blank comprising a plurality of panels comprising a front panel, a back panel, and at least one side panel, a plurality of end flaps foldably connected to respective panels of the plurality of panels, and dispenser features comprising a dispenser opening in the top panel, a first article engaging member attached to the top panel, and a second article engaging member attached to the top panel, the first article engaging member and the second article engaging member arranged in at least partial overlapping relation, at least one of the first article engaging member and the second article engaging member comprising a composite material. The method further comprises folding the plurality of panels at least partially around an interior of the carton such that the first article engaging member and the second article engaging member define a dispenser path from the interior of the carton to an exterior environment around the carton, and folding the plurality of end flaps to form at least one closed end of the carton.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Cartons according to the present disclosure can accommodate articles of numerous different shapes. For the purpose of illustration and not for the purpose of limiting the scope of the disclosure, the following detailed description describes articles such as tissues or other household products for being sequentially dispensed from such cartons. It will be understood that the articles can be different products, such as paper towels, napkins, sanitary or disinfecting wipes, etc., without departing from the disclosure.

In this specification, the terms "lower," "bottom," "upper," and "top" indicate orientations determined in relation to fully erected and upright cartons. As described herein, cartons can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
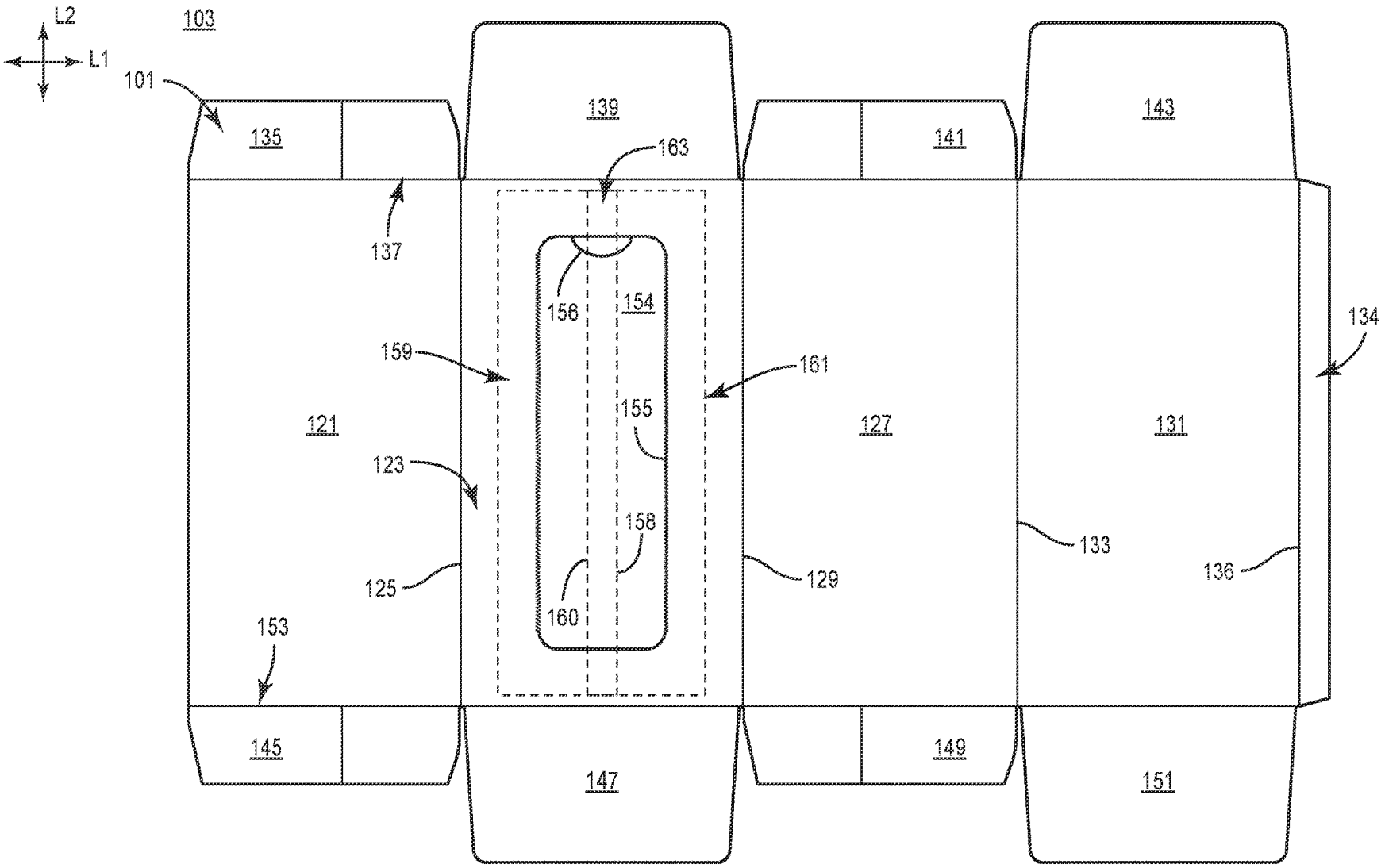
FIG. 1 is a plan view of an exterior surface of a blank used to form a carton according to an exemplary embodiment of the disclosure.

FIG. 1 is a plan view of an exterior surface 101 of a blank, generally indicated at 103, used to form a container or carton 105 (FIG. 2) according to an exemplary embodiment of the disclosure. As described further herein, the carton 105 can be provided with a dispenser 109 for accessing an interior 107 of the carton 105 and dispensing one or more articles A (FIG. 4) held in the interior 107 of the carton 105. The dispenser 109 can be formed of materials that have enhanced sustainability comparable to other materials. In some embodiments, the dispenser 109 can be devoid of polymeric materials such as plastic.

As shown in FIG. 1, the blank 103 can have a longitudinal axis L1 and a lateral axis L2, and a plurality of panels for extending at least partially around the interior 107 of the carton 105 formed from the blank 103. In the illustrated embodiment, the plurality of panels of the carton blank 103 can include a front side panel or front panel 121, a top side panel or top panel 123 foldably connected to the front panel 121 at a lateral fold line 125, a back side panel or back panel 127 foldably connected to the top panel 123 at a lateral fold line 129, and a bottom side panel or bottom panel 131 foldably connected to the back panel 127 at a lateral fold line 133. An attachment flap or attachment panel 134 can be foldably connected to the bottom panel 131 at a lateral fold line 136.

The blank 103 can also include a plurality of end flaps for forming at least one closed end of the carton 105. The end flaps can include a first front side end flap 135 foldably connected to the front panel 121 at a respective portion of a longitudinal fold line 137, a first top side end flap 139 foldably connected to the top panel 123 at a respective portion of the longitudinal fold line 137, a first back side end flap 141 foldably connected to the back panel 127 at a respective portion of the longitudinal fold line 137, and a first bottom side end flap 143 foldably connected to the bottom panel 131 at a respective portion of the longitudinal fold line 137. The end flaps 135, 139, 141, 143 can be for being at least partially overlapped to form a first closed end 111 of the carton 105 formed form the blank 103.

Similarly, a second front side end flap 145, a second top side end flap 147, a second back side end flap 149, and a second bottom side end flap 151 can be foldably connected to opposite ends of the respective panels 121, 123, 127, 131 at respective portions of a longitudinal fold line 153. The end flaps 145, 147, 149, 151 can be for being at least partially overlapped to form a second closed end 113 of the carton 105 formed from the blank 103. As shown, one or more of the end flaps 135, 139, 141, 143, 145, 147, 149, 151 can include one or more lines of weakening extending at least partially therealong to facilitate formation ends 111, 113 of the carton 105.

The blank 103 also includes dispenser features for forming the dispenser 109 of the carton 105. Such dispenser features can include a dispenser panel 154 separably connected to the top panel 123 at a generally U-shaped/rounded rectangular tear line 155. In the illustrated embodiment, an access cut/opening 156 can interrupt a portion of the tear line 155. The access cut 156 can be at least partially curved or otherwise shaped so as to be spaced apart from the top panel 123.

Figure 3:
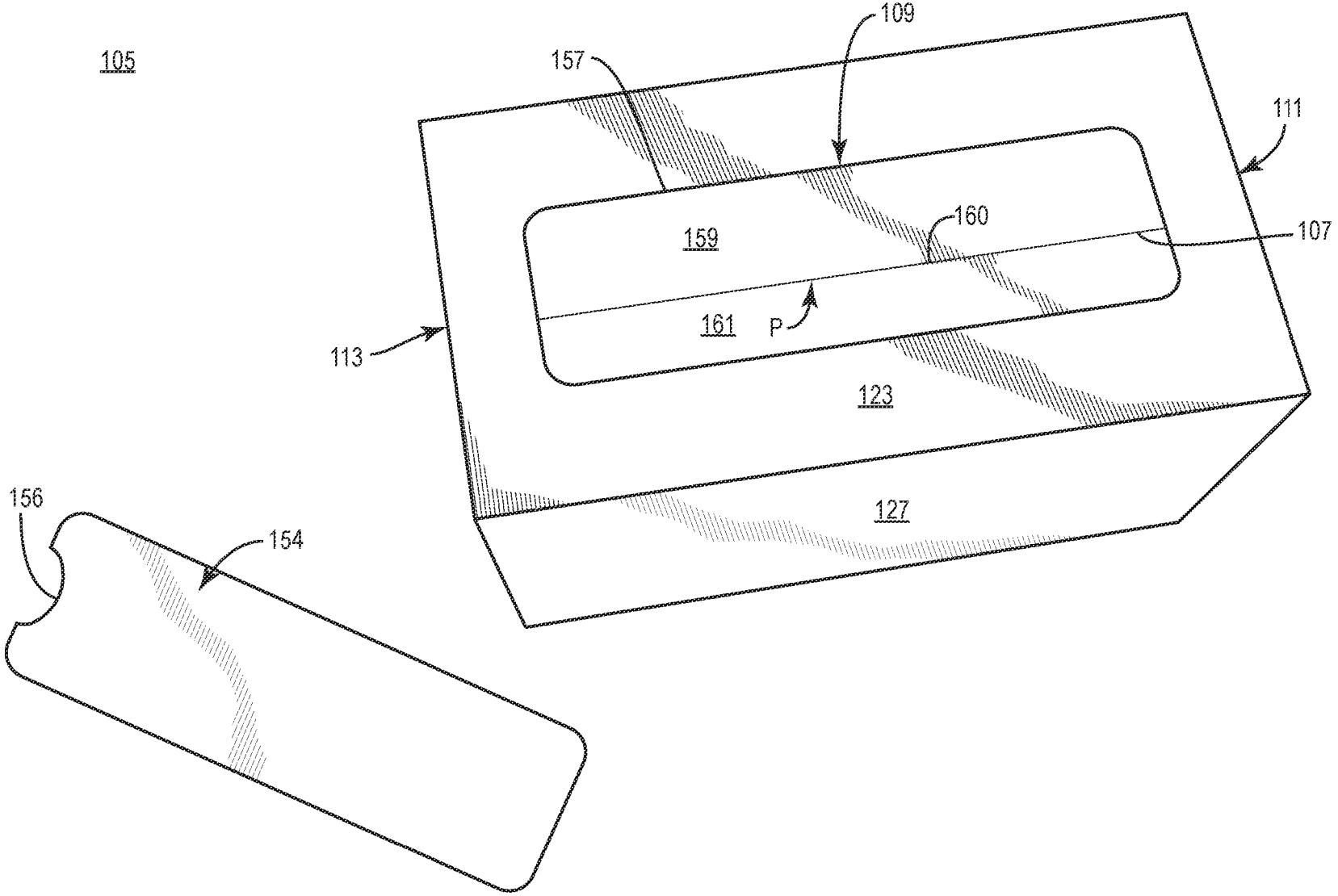
FIG. 3 is a perspective view of the carton of FIG. 2 with the dispenser panel removed.

As described further herein, the dispenser panel 154 can be at least partially separated from the top panel 123 at the tear line 155 to expose a dispenser opening 157 (FIG. 3). In one embodiment, the blank 103/carton 105 can be devoid of a dispenser panel 154 such that the dispenser opening 157 is exposed in an initial configuration of the blank 103/carton 105.

With continued reference to FIG. 1, a first article engaging member 159 and a second article engaging member 161 can each be attached to the interior surface 102 of the blank 103 overlapping the dispenser opening 157. In one embodiment, one or both of the first article engaging member 159 and the second article engaging member 161 can be adhered to an interior surface 102 of the blank 103 with an adhesive such as glue. In this regard, the article engaging members 159, 161 are shown in hidden lines to represent their position in at least partial face-to-face contact with an interior surface of the blank 103 and carton 105 formed therefrom, the interior surface of the blank 103 opposite the exterior surface 101 of the blank 103 and carton 105 formed therefrom. Accordingly, and as described further herein, the article engaging members 159, 161 are positioned in the interior 107 of the carton 105 formed from the blank 103.

Each article engaging member 159, 161 can be a generally flat or planar member, though can be at least partially flexible so as to be bent, curled, flexed, deflected, etc., or otherwise manipulated. In this regard, one or both article engaging member 159, 161 can be at least partially or fully formed from a composite material, e.g., parchment or a paper-based (e.g., paperboard) product such as kraft paper, clay-coated paperboard, solid bleached board (SBB) paperboard, solid bleached sulphate (SBS) paperboard, kraft liner paperboard, or another suitable material that is degradable, compostable, and/or repulpable. Such a selection of materials for the article engaging members 159, 161 can obviate the need for polymeric materials such as plastics, e.g., so as to reduce plastic waste and/or to streamline the recycling stream.

The article engaging members 159, 161 can be positioned in at least partial overlapping relation, e.g., so as to be in at least partial face-to-face contact. In the illustrated embodiment, a lateral free edge 158 of the article engaging member 159 can be positioned proximate but longitudinally spaced apart from a lateral free edge 160 of the article engaging member 161 to form an overlapping region 163 along which a dispenser path P (FIG. 3) can be defined, for example, from/proximate the lateral free edge 158, along facing surfaces of the article engaging members 159, 161, and to/proximate the lateral free edge 160. The overlapping region 163 and adjacent portions of the article engaging members 159, 161 can be positioned overlapping the dispenser opening 157.

While the present disclosure is directed to a pair of article engaging members 159, 161, it will be understood that a different number or arrangement of article engaging members could be provided without departing from the disclosure. For example, in one embodiment, a single article engaging member could be provided overlying the dispenser opening 157 and configured with one or more lines of weakening, e.g., cuts, slits, slots, etc., to at least partially form a dispenser path. Further, while the article engaging members 159, 161 have been described as forming a portion of the blank 103 herein, it will be understood that the article engaging members 159, 161 can be considered distinct elements that are attached to the blank 103.

As described herein, one or more of the dispenser opening 157, the article engaging members 159, 161, the dispenser panel 154, and associated features can be the dispenser features of the blank 103 for forming the dispenser 109 of the carton 105. It will be understood that a greater or fewer number of the aforementioned features can be the dispenser features without departing from the disclosure.

Figure 2:
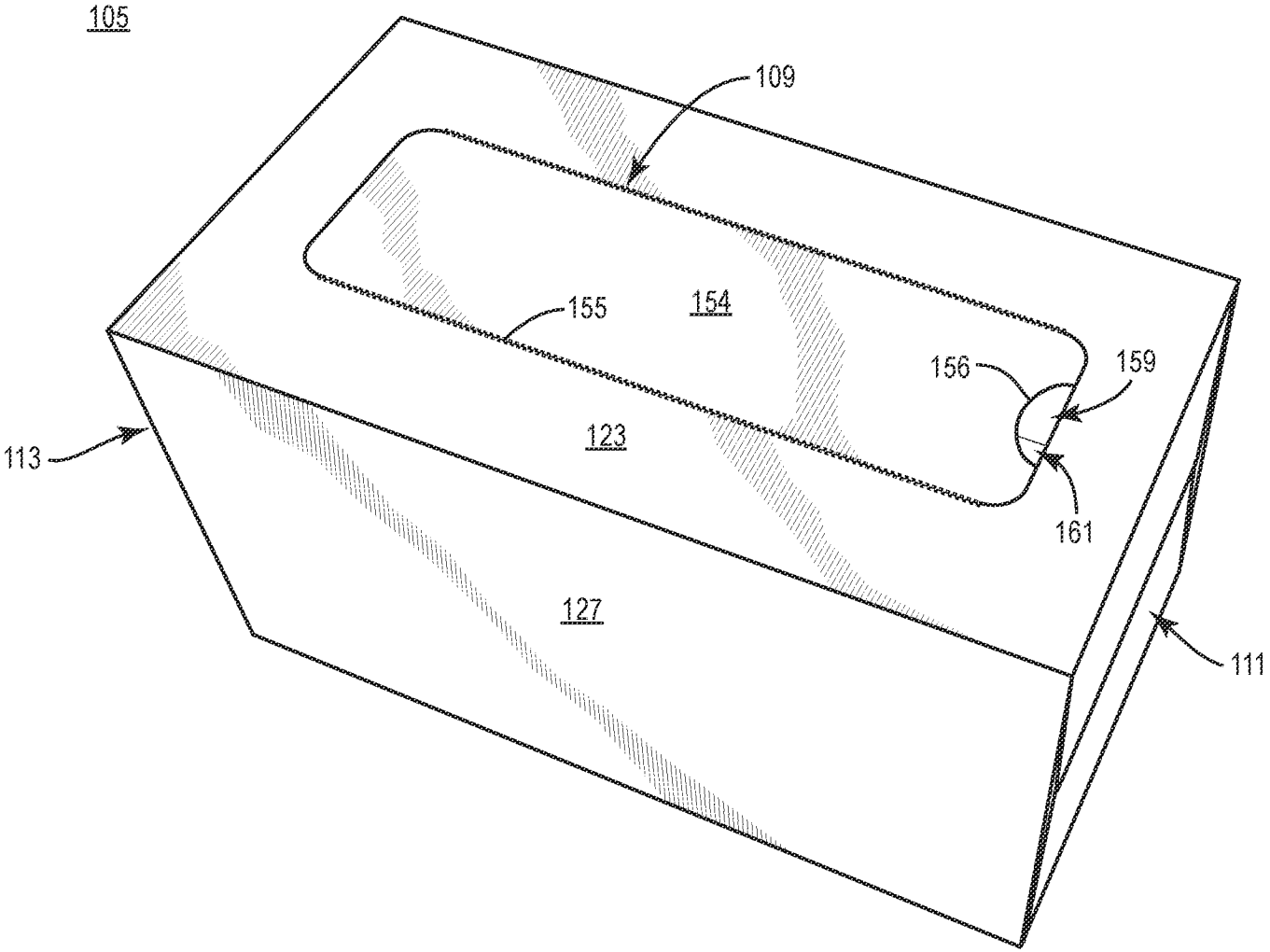
FIG. 2 is a perspective view of a carton formed from the blank of FIG. 1 according to an exemplary embodiment of the disclosure.
Figure 4:
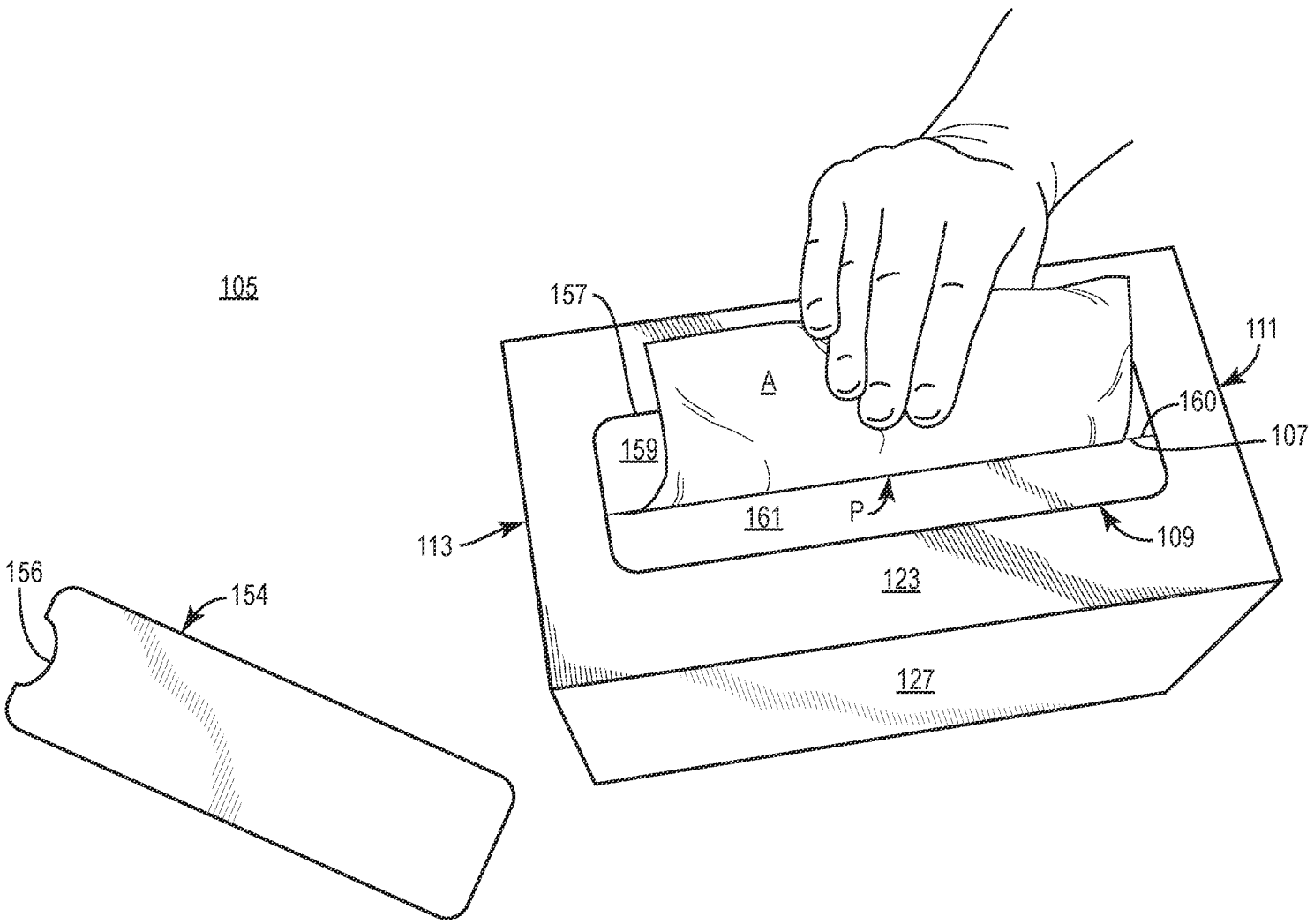
FIG. 4 is a perspective view of the carton of FIG. 2 with the dispenser panel removed and an article being withdrawn therefrom.

Referring additionally to FIGS. 2-4, formation of the carton 105 from the blank 103 will be described according to an exemplary embodiment of the disclosure. The blank 103 can be positioned with the exterior surface 101 thereof in contact with a supporting surface, e.g., in a face-down orientation, and with the interior surface of the blank 103 facing upwardly. The panels 121, 123, 127, 131 can be folded at the fold lines 125, 129, 133 at least partially around the interior 107 of the carton 105 and to position the front panel 121 and the back panel 127 in generally spaced and parallel relation and to position the top panel 123 and the bottom panel 131 in generally spaced and parallel relation. The attachment flap 134 can be folded at the fold line 136 and positioned in at least partial face to face contact with the front panel 121.

The end flaps 135, 139, 141, 143 can be folded at respective portions of the fold line 137 into at least partial overlapping relation to form the first closed end 111 of the carton 105, and the end flaps 145, 157, 159, 151 can be folded at respective portions of the fold line 153 into at least partial overlapping relation to form the second closed end 113 of the carton 105. Such an erected configuration of the carton 105 can be at least partially maintained via one or more applications of an adhesive such as glue.

In the erected configuration of the carton 105, in one embodiment, the dispenser 109 can be engaged/operated by a user by at least partially separating the dispenser panel 154 from the top panel 123 at the tear line 155 to expose the dispenser opening 157 and the article engaging members 159, 161 extending across the dispenser opening 157 in the interior 107 of the carton 105. The positioning of the relief cut/opening 156 can facilitate a user inserting one or more of his or her fingers therethrough to engage an edge or underside of the dispenser panel 154.

As shown best in FIG. 4, in one embodiment, e.g., in which a first article A in a series of articles is to be dispensed from the carton 105, a user can insert one or more fingers between the lateral free edges 158, 160 of the respective article engaging members 159, 161, to engage and withdraw a first article A therethrough, e.g., such that a leading portion of the article A is moved from the interior 107 of the carton 105, along the dispenser path P, and exposed on an exterior portion of the carton 105/an exterior environment surrounding the carton 105.

A leading portion of the article A exposed exteriorly of the carton 105 can be further pulled by a user to completely withdraw the remainder of the article A from the interior 107 of the carton 105, e.g., along the dispenser path P, for subsequent use independently of the carton 105. A plurality of articles can be arranged in the interior 107 of the carton 105 such that, upon withdrawal of a first article A, the leading portion of a subsequent article is carried at least partially along therewith and exposed exteriorly of the carton 105 to facilitate sequential dispensing of multiple articles.

It will be understood that the article engaging members 159, 161 can be arranged so as to provide a preselected degree of resistance to movement of the article A along the dispenser path P, for example, to provide a smooth, controlled, and/or tactilely enhanced movement of the article A. In some embodiments, features can be provided on one or more of the article engaging members 159, 161 to enhance such resistance, e.g., roughened surface patterns, serrated edges, frictionally-enhanced coatings, small tolerances of the dispenser path P, etc.

In view of the foregoing, the blank 103/carton 105 provides a carton for dispensing one or more articles in a smooth, controlled, and/or tactilely enhanced manner via a dispenser 109 that obviates the need for polymeric materials such as plastics, e.g., so as to reduce plastic waste and streamline the recycling stream. In some embodiments, the panels 121, 123, 127, 131, end flaps 135, 139, 141, 143, 145, 147, 149, 151, and dispenser features/dispenser 109 can be devoid of polymeric materials.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding and dispensing at least one article, the carton comprising:

a plurality of panels extending at least partially around an interior of the carton, the plurality of panels comprising a front panel, a back panel, a top panel, and a bottom panel; a plurality of end flaps foldably connected to a respective panel of the plurality of panels and forming at least one closed end of the carton; and a dispenser for accessing the interior of the carton, the dispenser comprising a dispenser opening in the top panel, a first article engaging member attached to the top panel, and a second article engaging member attached to the top panel, the first article engaging member and the second article engaging member arranged in at least partial overlapping relation to form an overlapping region defining a dispenser path the dispenser path allowing the at least one article to be withdrawn through the overlapping region between the first article engaging member and the second article engaging member and from the interior of the carton to an exterior environment around the carton, each of the first article engaging member and the second article engaging member comprising at least one of clay-coated paperboard, solid bleached board (SBB) paperboard, solid bleached sulphate (SBS) paperboard, or kraft liner paperboard, wherein first article engaging member has a first free edge and the second article engaging member has a second free edge spaced apart from the first free edge of the first article engaging member to define the overlapping region of the first article engaging member and the second article engaging member and wherein each of the first article engaging member and the second article engaging member at least partially overlap the dispenser opening.

2. The carton of claim 1, wherein each of the first article engaging member and the second article engaging member are at least partially positioned in the interior of the carton.

3. The carton of claim 2, wherein each of the first article engaging member and the second article engaging member are attached to an interior surface of the top panel.

4. The carton of claim 2, wherein the dispenser further comprises a dispenser panel separably connected to the top panel such that the dispenser panel is separable from the top panel to expose the dispenser opening.

5. The carton of claim 4, wherein the dispenser panel includes a relief cut spaced away from the top panel.

6. The carton of claim 1, wherein the overlapping region is positioned overlapping a portion of the dispenser opening.

7. The carton of claim 1, wherein the at least one closed end of the carton is a first closed end of the carton, and the plurality of end flaps are overlapped to form a second closed end of the carton.

8. The carton of claim 1, wherein the plurality of panels, the plurality of end flaps, and the dispenser are devoid of polymeric material.

9. A blank for forming a carton for holding and dispensing at least one article, the blank comprising:

a plurality of panels for extending at least partially around an interior of the carton formed from the blank, the plurality of panels comprising a front panel, a back panel, a top panel, and a bottom panel;

a plurality of end flaps foldably connected to a respective panel of the plurality of panels for forming at least one closed end of the carton formed from the blank; and dispenser features for forming a dispenser for accessing the interior of the carton formed from the blank, the dispenser features comprising a dispenser opening in the top panel, a first article engaging member attached to the top panel, and a second article engaging member attached to the top panel, the first article engaging member and the second article engaging member arranged in at least partial overlapping relation to form an overlapping region defining a dispenser path the dispenser path allowing the at least one article to be withdrawn through the overlapping region between the first article engaging member and the second article engaging member and from the interior of the carton formed from the blank to an exterior environment around the carton formed from the blank, each of the first article engaging member and the second article engaging member comprising at least one of clay-coated paperboard, solid bleached board (SBB) paperboard, solid bleached sulphate (SBS) paperboard, or kraft liner paperboard, wherein each of the first article engaging member and the second article engaging member at least partially overlap the dispenser opening, and wherein the first article engaging member has a first free edge and the second article engaging member has a second free edge spaced apart from the first free edge of the first article engaging member to define the overlapping region of the first article engaging member and the second article engaging member.

10. The blank of claim 9, wherein each of the first article engaging member and the second article engaging member are for being at least partially positioned in the interior of the carton formed from the blank.

11. The blank of claim 10, wherein each of the first article engaging member and the second article engaging member are attached to an interior surface of the top panel.

12. The blank of claim 10, wherein the dispenser features further comprises a dispenser panel separably connected to the top panel such that the dispenser panel is separable from the top panel to expose the dispenser opening when the dispenser is formed.

13. The blank of claim 12, wherein the dispenser panel includes a relief cut spaced away from the top panel.

14. The blank of claim 9, wherein the overlapping region is positioned overlapping a portion of the blank opening.

15. The blank of claim 9, wherein the at least one closed end of the carton formed from the blank is a first closed end of the carton formed from the blank, and the plurality of end flaps are for being overlapped to form a second closed end of the carton formed from the blank.

16. The blank of claim 9, wherein the plurality of panels, the plurality of end flaps, and the dispenser features are devoid of polymeric material.

17. A method of forming a carton for holding and dispensing at least one article, the method comprising:

obtaining a blank comprising a plurality of panels, a plurality of end flaps, and dispenser features, the plurality of panels comprising a front panel, a back panel, a top panel, and a bottom panel, the dispenser features comprising a dispenser opening in the top panel, a first article engaging member attached to the top panel, and a second article engaging member attached to the top panel, the first article engaging member and the second article engaging member arranged in at least partial overlapping relation;

folding the plurality of panels at least partially around an interior of the carton; overlapping the plurality of end flaps to form at least one closed end of the carton; and positioning the dispenser features to form a dispenser of the carton for accessing the interior of the carton and such that the first article engaging member and the second article engaging member are at least partially overlapped to form a dispenser path the dispenser path allowing the at least one article to be withdrawn through an overlapping region between the first article engaging member and the second article engaging member and from the interior of the carton to an exterior environment around the carton, each of the first article engaging member and the second article engaging member comprising at least one of clay-coated paperboard, solid bleached board (SBB) paperboard, solid bleached sulphate (SBS) paperboard, or kraft liner paperboard, wherein first article engaging member has a first free edge and the second article engaging member has a second free edge spaced apart from the first free edge of the first article engaging member to define the overlapping region of the first article engaging member and the second article engaging member and wherein each of the first article engaging member and the second article engaging member at least partially overlap the dispenser opening.

18. The method of claim 17, wherein positioning the dispenser features comprises positioning each of the first article engaging member and the second article engaging member at least partially in the interior of the carton.

19. The method of claim 18, wherein each of the first article engaging member and the second article engaging member are attached to an interior surface of the top panel.

20. The method of claim 18, wherein the dispenser features further comprise a dispenser panel separably connected to the top panel such that the dispenser panel is separable from the top panel to expose the dispenser opening when the dispenser is formed.

21. The method of claim 20, wherein the dispenser panel includes a relief cut spaced away from the top panel.

22. The method of claim 17, wherein the overlapping region is positioned overlapping a portion of the dispenser opening.

23. The method of claim 17, wherein the at least one closed end of the carton is a first closed end of the carton, and overlapping the plurality of end flaps further comprises forming a second closed end of the carton.

24. The method of claim 17, wherein the plurality of panels, the plurality of end flaps, and the dispenser are devoid of polymeric material.

* * * * *